United States Patent [19]

Denis

[11] Patent Number: 4,997,225

[45] Date of Patent: Mar. 5, 1991

[54] PIPE RETRIEVER

[76] Inventor: Greg St. Denis, 75 Central St., Boylston, Mass. 01505

[21] Appl. No.: 451,510

[22] Filed: Dec. 15, 1989

[51] Int. Cl.[5] ..... E21B 31/20

[52] U.S. Cl. ..... 294/86.25; 294/95

[58] Field of Search ..... 294/86.25, 95, 97, 116, 294/86.24, 89, 94, 96

[56] References Cited

U.S. PATENT DOCUMENTS

| | | | |
|---|---|---|---|
| 718,066 | 1/1903 | McWilliams | 294/95 X |
| 1,445,680 | 2/1923 | Guess | 294/86.25 X |
| 1,580,352 | 4/1926 | Ventresca | 294/86.25 X |
| 2,634,156 | 4/1953 | Crimmel | 294/95 |
| 3,858,731 | 1/1975 | Briggs | 214/1 PA |
| 3,874,446 | 4/1975 | Crowe | 166/129 |
| 3,881,375 | 5/1975 | Kelly | 81/57.35 |
| 3,882,377 | 5/1975 | Kelly | 324/37 |
| 3,944,273 | 3/1976 | Ahlstone | 294/86.1 |
| 3,987,910 | 10/1976 | Brunato | 214/2.5 |
| 3,990,510 | 11/1976 | Decuir | 166/128 |
| 4,030,544 | 6/1977 | Ahlstone | 166/182 |
| 4,254,983 | 3/1981 | Harris | 294/86.21 |
| 4,298,066 | 11/1981 | Colonna et al. | 166/300 |
| 4,364,587 | 12/1982 | Samford | 285/3 |
| 4,431,057 | 2/1984 | Colonna et al. | 166/285 |
| 4,450,606 | 5/1984 | Broussard | 188/67 |
| 4,497,371 | 2/1985 | Lindsey, Jr. | 166/377 |
| 4,616,855 | 10/1986 | Ruhle | 285/24 |
| 4,637,468 | 1/1987 | Derrick | 166/297 |
| 4,664,419 | 5/1987 | Tan et al. | 285/31 |
| 4,725,179 | 2/1988 | Woolslayer et al. | 414/22 |

*Primary Examiner*—Margaret A. Focarino
*Assistant Examiner*—Dean J. Kramer
*Attorney, Agent, or Firm*—Weingarten, Schurgin, Gagnebin & Hayes

[57] ABSTRACT

A pipe retrieving tool has two arms with outward facing teeth adapted to engage inner threads of a pipe. A surface retrieving line attaches to a weighted actuator, which is positioned to move over a limited range relative to the arms. The tool is lowered into a pipe to be retrieved from a well. Once inside the pipe, a pull on the surface retrieving line raises the weighted actuator. This forces the arms outward, causing the teeth to engage the inner threads of the pipe. With the teeth engaging the pipe threads, the pipe can be lifted out of the well.

10 Claims, 2 Drawing Sheets

PIPE RETRIEVER

BACKGROUND OF THE INVENTION

This invention relates generally to an apparatus for retrieving a pipe from a well. More particularly, the apparatus is adapted for retrieval of a pipe segment used for testing soil for leakage of oil from underground storage. Such testing might typically occur at a depth of approximately 50 feet.

Pipe segments occasionally become detached in the process of being installed in a well. This is problematic not only because the segment itself is lost at the well bottom, but also because the lost segment blocks the well, making the well useless and requiring redrilling in a separate location. It is therefore desirable to have a tool for retrieving such segments.

Prior patents, such as U.S. Pat. Nos. 3,944,273 and 4,254,983, involve specialized retrieval tools. These tools are designed to retrieve specific objects, and these objects are designed with retrieval in mind. Lacking from the prior art is a device which can attach to any ordinary inner-threaded pipe, within a range of pipe diameters. Such a device is desirable, since many pipes which fall into wells are not specifically designed to couple to a specialized retrieval tool.

BRIEF SUMMARY OF THE INVENTION

It is an object of this invention to provide an apparatus for retrieving a pipe from a well. It is a further object of this invention to provide an apparatus which can be lowered down a well and into the upper end of a pipe, but which is adapted such that an upper component of the apparatus rests on the upper end of the pipe and does not pass into the pipe.

It is a further object of this invention to provide a means by which the apparatus can be lowered into the well and, once the apparatus is engaged in the pipe, by which the apparatus and the pipe can be raised from the well. It is a further object of this invention to provide a mechanism for engaging the apparatus in the inner threads of the pipe once the apparatus has been lowered into place, and for keeping the apparatus engaged while the apparatus and pipe are being raised.

These objects are accomplished in part by providing an upper disk at the upper end of the apparatus, said upper disk being large enough to rest on the upper edge of the pipe while other components of the apparatus hang down into the pipe from the upper disk. A surface retrieving line attached to a shaft which passes through the upper disk, allows the device to be raised and lowered. The mechanism for engaging the apparatus in the pipe includes an actuator means in the shape of a truncated conic wedge, attached to the bottom of said shaft. The mechanism also includes two arms on opposite sides of said shaft, which are adapted to move outward when the actuator means is raised. The arms have outward facing teeth, which are adapted to engage the inner threads of the pipe when the arms are moved outward. Once the teeth are engaged, the apparatus and the pipe can be raised together. The weight of the suspended pipe serves to wedge the actuator means more firmly against the arms, insuring that the teeth will remain engaged in the pipe threads.

BRIEF DESCRIPTION OF THE DRAWINGS

These and other features of the present invention are more fully set forth in the following solely exemplary detailed description and accompanying drawings of which.

DETAILED DESCRIPTION

Figure 1:
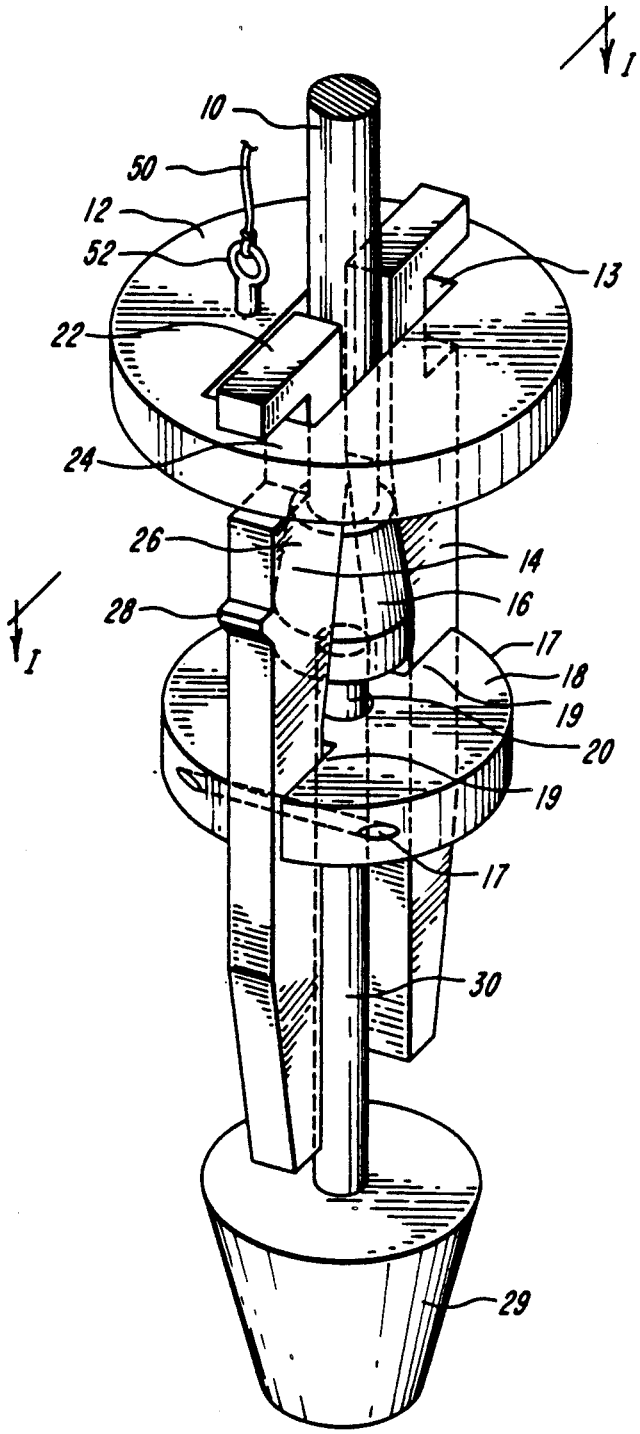
FIG. 1 is a perspective view, showing the various components of the retrieval apparatus.

The components of the pipe retriever apparatus may be perceived by reference to FIG. 1, and include an upper disk 12 with an outer diameter greater than the inner diameter of the pipe to be retrieved, through which a centered, rectangular, longitudinal slot 13 has been cut. An upper shaft 10 runs longitudinally through the slot 13, and two arms 14 are held parallel to the shaft 10 on opposite sides of the shaft. Each arm has a bottom section 26, with an outer facing surface having an outer facing tooth 28 adapted to engage the inner threads of a pipe to be raised. The bottom surfaces of teeth 28 are tapered to facilitate entry of the apparatus into the pipe. On each arm, a neck section 24 extends longitudinally upward from the bottom section through the slot 13 on either side of the shaft 10 to an arm head 22, which extends radially outward from the top of the neck. The heads 22, necks 24, and bottom sections 26 of each arm form rectangular "C" shapes facing radially outward, in which the upper disk is captured. The inner facing surfaces of the bottom sections 26 opposite to the teeth 28 are tapered upward-inward. A conic wedge 16, slanting upward-inward and truncated at its top, is attached to the bottom of the upper shaft 10 between the tapered surfaces of the bottom sections 26 so that its axis of symmetry runs longitudinally through the center of the upper shaft. A lower shaft 30 is connected at its top to the bottom of the conical wedge 16, and at its bottom to a drop weight 29.

The apparatus also includes a lower disk 18, with an outer diameter less than the inner diameter of the pipe to be retrieved, whose axis of symmetry runs longitudinally through the center of the lower shaft 30. A cylindrical hole 20, with a diameter slightly greater than the diameter of the lower shaft 30, has been cut through the center of the lower disk 18, so that the axis of symmetry of the cylindrical hole runs longitudinally through the center of the shaft. Two longitudinal slots 19 have been cut from the outer edge of the lower disk 18 on opposite sides of the axis of symmetry of the lower disk 18, so that the two slots and the axis of symmetry of the lower disk 18 lie in a single plane. The width of each slot 19 is slightly greater than the thickness of an arm bottom section 26. Two holes 17 have been cut through the body of the lower disk 18, on opposite sides of the lower disk's axis of symmetry and through the slots 19. The holes are cylindrical and parallel to each other, in a plane perpendicular to the shaft 10, through the longitudinal middle of the lower disk.

The lower shaft 30 runs through the cylindrical hole 20 in the lower disk 18, and the bottom sections 26 run through and lower in the slots 19 in the lower disk 18. Pivot pins are inserted into the holes 17 in the lower disk 18 through the arm bottom sections 26. The pivot pins serve to anchor the bottom sections 26, but allow some freedom for the arms 14 to lower. The conic wedge 16 has a limited range of longitudinal motion between the upper disk 12 and the lower disk 18. At the lower end of its range of motion relative to the lower disk 18, the conic wedge 16 rests on the lower disk. At the upper end of its range of motion, the conic wedge 16 is wedged between the inward slanting surfaces of the bottom sections 26, slightly below the upper disk, forcing the bottom sections 26 outward to engage the pipe threads via teeth 28.

Figure 4:
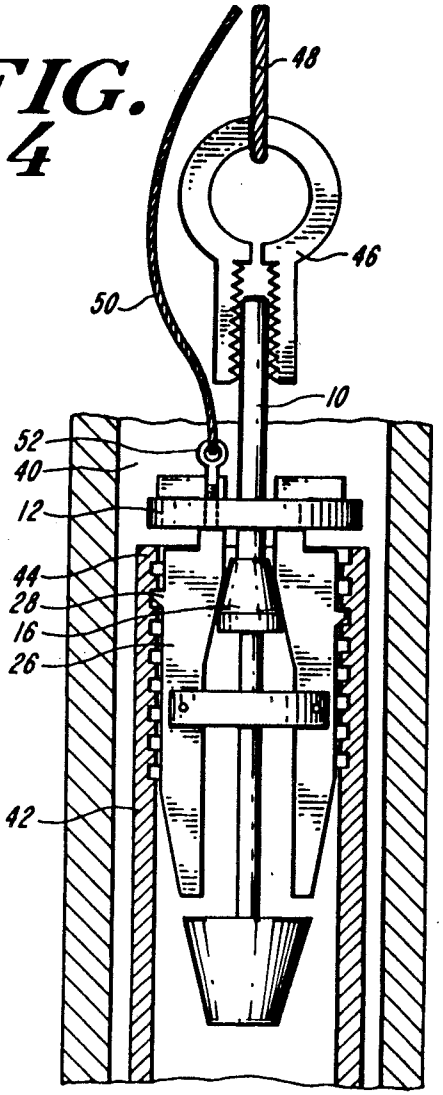
FIG. 4 is a partial longitudinal, sectional view and partial plan view showing the retrieval apparatus of the invention, together with the pipe, being lifted out of the well.
Figure 3:
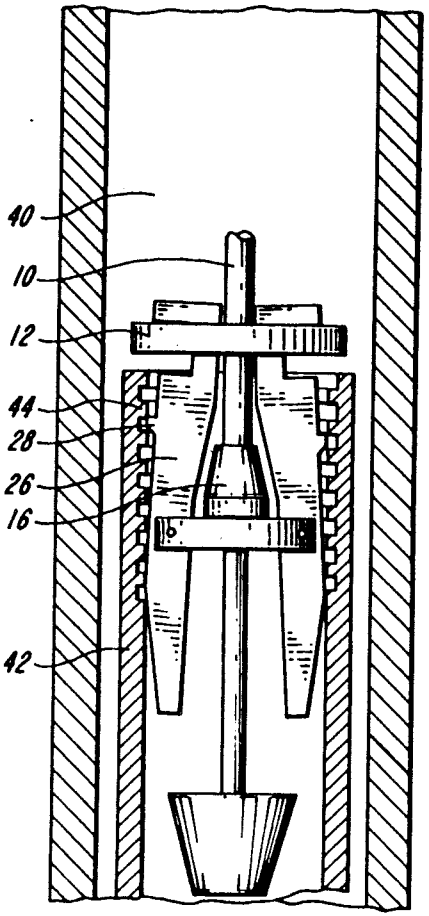
FIG. 3 is a partial longitudinal, sectional view and partial plan view showing the retrieval apparatus of the invention inside the pipe, engaging the pipe's inner threads.
Figure 2:
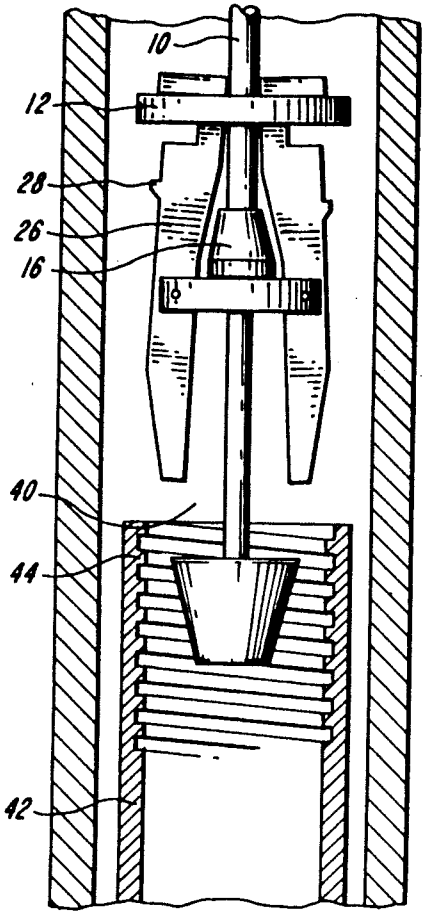
FIG. 2 is a partial longitudinal, sectional view and partial plan view showing the retrieval apparatus of the invention being dropped down a well, into a pipe.

FIGS. 2–4 show the device in use to retrieve a pipe 42.

FIG. 2 shows the device being dropped into a well 40 to retrieve pipe 42 which has been lost at the bottom. In the falling state there is no upward force on the shaft 10. The conic wedge 16 is on or slightly above the lower disk 18, and exerts no outward force on the arms 14. As the device begins to enter the pipe 42, the tapered bottom outer surfaces of the teeth 28 are pushed inward. The device continues to fall until the upper disk 12 contacts the pipe 42.

Pulling on the shaft 10 via a line 48 on a ring 46 forces conic wedge 16 upward, forcing the portion of the arm bottom 26 above the pivot pins outward so that the teeth 28 on bottom sections 26 move outward to engage threads 40 of the pipe 42. These outward forces serve to lock the device against the inside of the pipe 42.

As shown in FIG. 4, the teeth remain fully engaged as the pulling continues upward on the drop line 48. As the shaft 10 is raised, the conic wedge 16 stays wedged against the bottom sections 26, continuously forcing the teeth 28 outward against the pipe threads 44. The weight of the pipe 42 then rests on the teeth 28. The weight exerts a downward force on the teeth 28 and bottom sections 26, which serves to wedge the conic wedge 16 between the bottom sections 26 more firmly. The pipe can then be raised out of the well.

What is claimed is:

1. A device for retrieving a pipe from a well, comprising:

plural arms;

means for supporting said plural arms including a lower disk having peripheral slots for receiving each of said plural arms and means for pivoting each of said plural arms within the slots of said lower disk;

teeth on outwardly facing surfaces of said arms;

an upper disk constraining the outward motion of said arms;

an actuator positioned to move relative to the arms over a range of motion between upper and lower limits and having an inclined surface abutting said arms;

the inclined surface at the lower limit of said range of motion, allowing the arms to move inward;

the actuator responding to upward force to move the inclined surface toward the upper limit of said range of motion to force the arms outward into a position at which the teeth engage inner threads of a pipe to be retrieved.

2. The device of claim 1 wherein said teeth have on a bottom surface thereof a slope adapted to facilitate entry of said device into a pipe under the action of the device's weight.

3. The device of claim 1 wherein said teeth are vertically offset to match inner threads of said pipe.

4. The device of claim 1 wherein said upper disk has plural slots arrayed around a center of said disk, each of said plural slots accommodating one of said plural arms in slots in the arms.

5. The device of claim 1 wherein said actuator further includes:

a shaft extending centrally through said upper disk and between said plural arms.

6. The device of claim 5 further including means associated with said shaft to permit attachment of a retrieving line thereto.

7. The device of claim 5 wherein said inclined surface includes a cone having said shaft therethrough.

8. The device of claim 5 further including a weight attached to a bottom portion of said shaft.

9. A method for retrieving a pipe having inner threadings on upper portions from a well, comprising the steps of:

lowering into said well plural arms having on outward facing surfaces thereof teeth adapted to engage the inner thread of said pipe and having supporting means including a lower disk having peripheral slots for receiving each of said plural arms, and means for pivoting each of said plural arms within the slots of said lower disk;

retaining said arms in said pipe at a location where said teeth face the inner threads of said pipe;

forcing outward said arms to cause the teeth thereof to engage the inner threads of said pipe;

pulling said arms upwardly while maintaining the outward force on said arms which causes said teeth to engage said inner threads thereby raising said pipe from a well.

10. The method of claim 9 wherein said step of forcing said arms outward includes the step of pulling on a shaft running centrally through said plural arms which has thereon a cone forcing the cone to engage sloping inner surfaces of said arms which in turn forces said arms outward.

* * * * *